United States Patent [19]

Dickerson et al.

[11] 4,409,758

[45] Oct. 18, 1983

[54] PERIMETER STRIP FOR MAGNETICALLY ATTRACTABLE EXTRUDED PLASTIC WINDOW SYSTEM

[75] Inventors: Albert Dickerson; John Szlag, both of Columbus, Ohio; John Reyle, Teaneck, N.J.

[73] Assignee: Plaskolite, Inc., Columbus, Ohio

[21] Appl. No.: 243,188

[22] Filed: Mar. 12, 1981

[51] Int. Cl.[3] ..... E06B 3/32; E05B 65/04

[52] U.S. Cl. ..... 49/463; 49/62; 52/202

[58] Field of Search ..... 49/62, 63, 67, 463–466, 49/501; 52/202, 203, 716–718, 476

[56] References Cited

U.S. PATENT DOCUMENTS

| | | | |
|---|---|---|---|
| 1,946,169 | 2/1934 | MacKenzie | 49/67 |
| 2,219,699 | 10/1940 | Owen | 20/565 |
| 2,595,833 | 5/1952 | Flaherty | 160/369 |
| 3,178,776 | 4/1965 | Stansberry | 49/463 X |
| 3,360,893 | 1/1968 | Wattelez | 52/105 |
| 3,363,390 | 1/1968 | Crane et al. | 52/716 |
| 3,679,505 | 7/1972 | Hinderaker et al. | 156/71 |
| 3,805,872 | 4/1974 | Lorber | 160/354 |
| 3,939,620 | 2/1976 | Bero | 52/716 |
| 4,065,900 | 1/1978 | Eggert | 52/476 |
| 4,069,641 | 1/1978 | DeZutter | 42/202 |
| 4,121,379 | 10/1978 | Everson | 52/202 X |
| 4,184,297 | 1/1980 | Casamayor | 52/202 |
| 4,248,018 | 2/1981 | Casamayor | 49/504 |
| 4,272,942 | 6/1981 | Jackson | 52/202 X |

OTHER PUBLICATIONS

General Tire & Rubber Co., Magnetic Products Technical Bulletin No. 1-EM 1-77 "Gen-Mag" Extruded Thermoplastic Magnets.

Magnetic Specialty, Inc., "Pro Mag Power Rated Magnetic Sheet & Strip".

B. F. Goodrich Co. "Koroseal Flexible Magnetic Sheet & Strip," FPD-80-FP-1001 and Information Bulletin K-4.2-7-79.

*Primary Examiner*—Philip C. Kannan

*Attorney, Agent, or Firm*—Porter, Wright, Morris & Arthur

[57] ABSTRACT

An improved perimeter strip for a magnetically attached auxiliary window system which includes gasket means (1) on the interior surfaces of a glazing holding channel of the strip and (2) adjacent the magnetic attachment means, whereby a flexibly tensional relationship between the strip and the magnetically attractable means associated therewith is provided.

8 Claims, 25 Drawing Figures

PERIMETER STRIP FOR MAGNETICALLY ATTRACTABLE EXTRUDED PLASTIC WINDOW SYSTEM

FIELD OF THE INVENTION

This application describes an improved auxiliary window system for insulating, or environmental control purposes, which is to be installed adjacent an existing prime window.

THE PRIOR ART

The prior art includes many forms of auxiliary window coverings which are to be attached to an existing prime window frame. Among the types of auxiliary windows are insulating windows framed with dual durometer extruded plastic framing strips, used in conjunction with sheet plastic glazing, such as are shown in U.S. Pat. Nos. 3,939,620 to Bero and 4,184,297 and 4,248,018 to Casamayor. Other types of auxiliary windows and framing strips are described in U.S. Pat. Nos. 3,360,893 (to Wattelez) and 4,069,641 (to DeZuter). Such types of auxiliary windows generally use extruded frame strips and mechanical fastening means in the frame strips to hold the glazing pane of an auxiliary window adjacent to the prime window.

In connection with affixing an auxiliary window, magnetic attraction has been described as a suitable means for fastening a removable auxiliary window adjacent to a prime window frame. For example, the use of magnetic attraction as a fastening means for an auxiliary window is described in U.S. Pat. No. 2,219,669 which shows magnets in contact with a metal "U" shaped frame which surrounds the perimeter of the auxiliary window pane. This patent also relates that cushioning strips or resilient material may be used in conjunction with such magnetically affixed auxiliary window panes. Other U.S. Pat. Nos. 2,595,833; 3,679,505 and 3,805,872, show the use of thin flexible perimeter strips in conjunction with magnetically providing a removable insert for a window opening.

It is thus the state of the art that the use of magnetic means and magnetic strip means to hold an auxiliary window pane which is mounted in a U-shaped perimeter channel to a prime window frame, and the use of resilient material therewith, is within the skill of the art.

Known types of such windows present several disadvantages: (1) Some types employ magnetic attracting means either on both the auxiliary glazing panel and the prime window perimeter to which the auxiliary glazing is attached, or solely on the auxiliary panel. Since the conventionally used magnetic strips are relatively expensive, the expense of "duplicate" strips may preclude the use of such windows by certain customers and/or applications. (2) While magnetic means may provide a firm attachment, some types of such windows may slip or become dislodged by an inadvertant displacement of the magnetic alignment. If this occurs the possibility exists that the entire auxiliary window may fall out. (3) "Opening" a magnetically attached window may entail removing the entire auxiliary panel. "Closing" the window by putting back the removed panel entails realigning the magnetic attraction means anew. (4) Also, in some types of such windows, a secure weather seal may not result between the magnetic attraction member of the auxiliary glazing panel and the corresponding member at the prime window perimeter. Insulating efficiency is thus reduced and physical attachment may not be secure.

These disadvantages of such types of magnetic windows spring principally from the fact that design considerations for such windows are limited simply to supplying a magnetic attraction means for the perimeter trim. This approach has overlooked problems, such as those described above, which are encountered when magnetic means are employed. Heretofore, these, and other problems do not appear to have been addressed.

In view of these difficulties with the prior art types of windows, it is an object of this invention to provide an economical, secure and conveniently openable "magnetic" auxiliary window which provides insulating efficiency and is useful under various seasonal conditions and with different types of auxiliary panels.

OBJECTS OF THE INVENTION

The following is an improved auxiliary window system which is fastened by magnetic means to the perimeter area surrounding a prime window. The system further provides improved perimeter framing strips which hold glazing (or other panel types) of the auxiliary window and may also include an optional "hinged" dividing strip in the glazing which will allow an installed window of the system conveniently to be opened.

It is an object to provide a more economical auxiliary window in which magnetic fastening means is applied only to the prime window frame. Thus, the same magnetic strip may be used in an overall environmental control system which includes a summer type panel product, such as an insect screen for ventilating, or sun screen or solar reflective film, as well as a winter insulating window.

A co-extruded perimeter trim is provided for such panels in which a steel band is held in a channel in a rigid framing trim; flexible, resilient gaskets are included which allow the steel band to "float" slightly with respect to the rigid framing trim. The "float" allows a better seal and improved magnetic attachment between the steel of the perimeter trim and the magnet attached to the prime window perimeter. Further, flexibility, in the steel/magnet attachment is provided between the magnet and the steel by reason of the "float" achieved by the resilient gaskets.

The slight "float" of the glazing perimeter trim will also allow improved adhesion of the auxiliary window to the magnetic means in the event of wind pressure or thermal expansion of the auxiliary glazing pane by providing "pivot" flexibility in the magnet/steel perimeter trim interface.

Because the actual force holding the auxiliary window is a function of magnetic force and the friction coefficient between the magnetically attractable members, the auxiliary window may slide on some prior art designs. In the system of this application this problem is avoided: Accessory clips may be conveniently employed to insure against accidental detachment of the window (1) by reason of unfamiliarity with the system or (2) by the build up of excessive pressure due to wind and/or thermal expansion. In this connection, a framing member for glazing is employed which provides a lip which fits around the magnetic strip applied to the prime window perimeter. The lip on the framing trim will also assist in the prevention of sliding or detachment of the auxiliary window from the magnetic attraction means.

And it is a yet further object economically to provide a magnetically adherable auxiliary window unit which is compatible with conventional extruded perimeter trim strips, whereby such conventional trim strips will securely maintain a glazing pane at the prime window location to cover a portion of the window, and the magnetic system herein will provide a conveniently openable segment with respect to the overall auxiliary window system.

Among further objects if the provision of an extrusion produced dual durometer vinyl perimeter trim for a magnetically affixed auxiliary window. In this connection, the effectiveness of the seal between the auxiliary window and the prime window may be improved to an even greater degree by including co-extruded flexible or rigid gasket elements on legs of the perimeter trim.

It is also an object to provide such an auxiliary window in conjunction with a hinge strip which divides the glazing to allow the window to be conveniently opened for ventilation or other purposes; an auxiliary window which is simpler in design than prior art forms of such windows such as are depicted and referred to in U.S. Pat. No. 4,248,018 is achieved.

These foregoing objects are accomplished by various combinations of diverse elements of the system which is more particularly described by reference to the drawings and following description of the preferred embodiment.

DESCRIPTION OF THE PREFERRED EMBODIMENT

Figure 1:
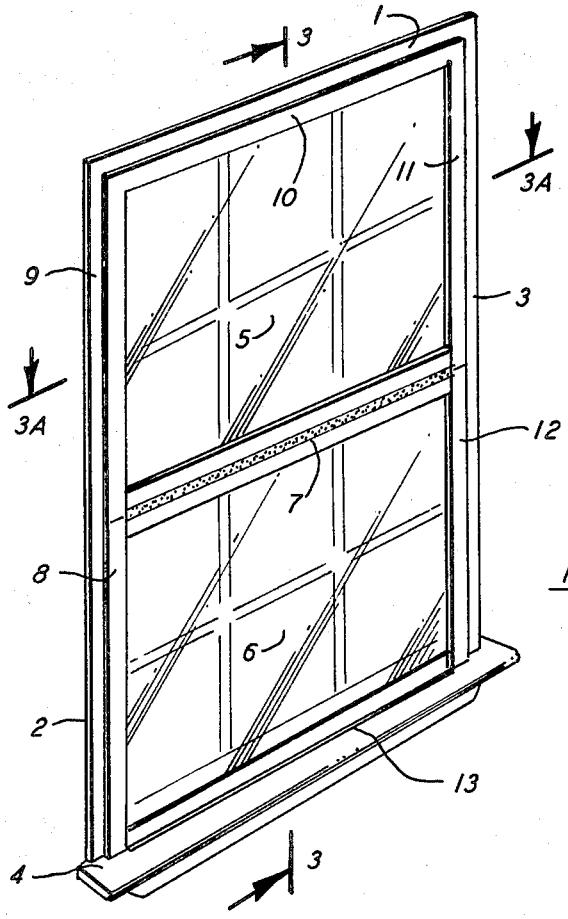
FIG. 1 is a view of an embodiment of the window system installed at an existing prime window.
Figure 2:
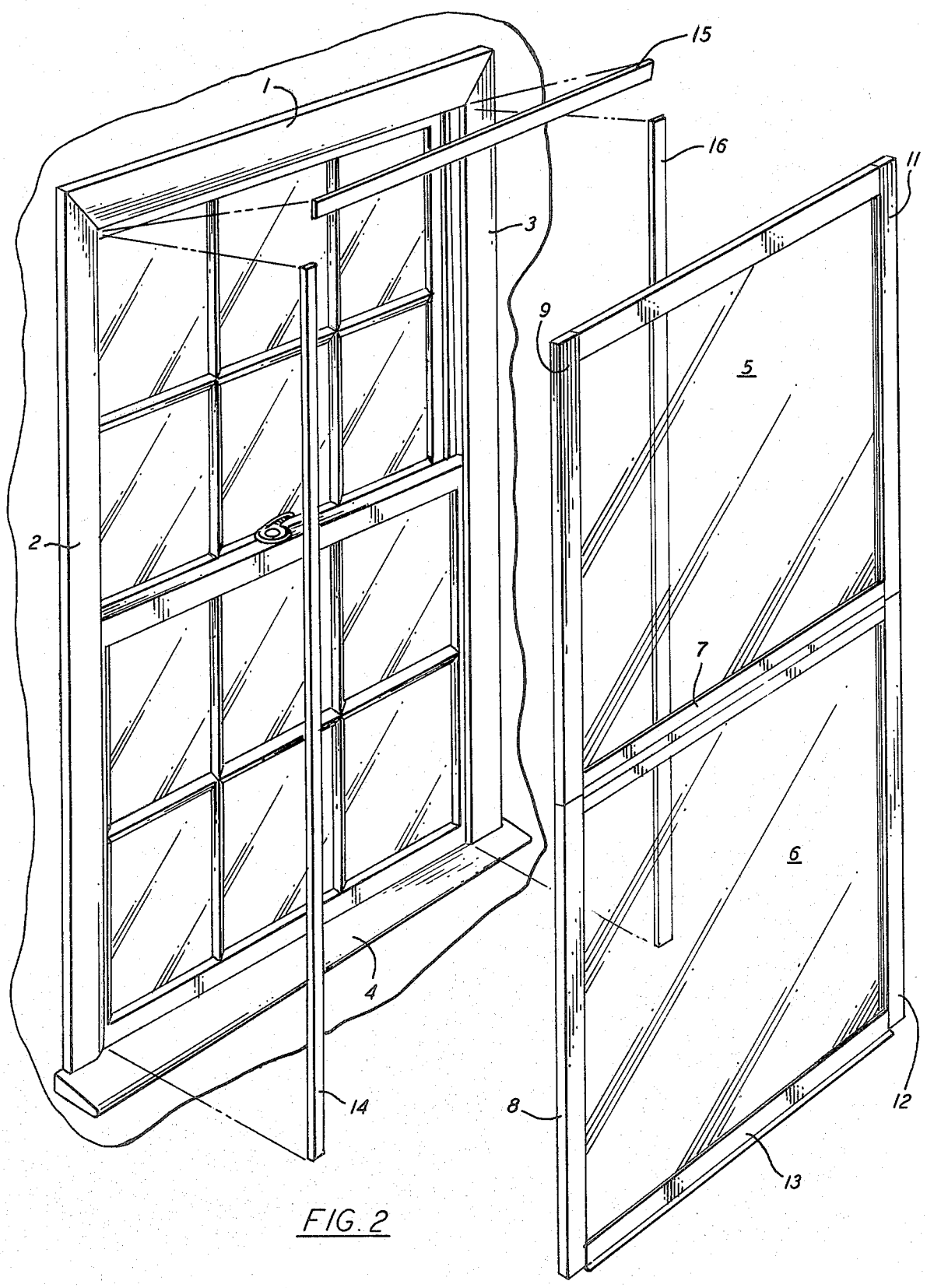
FIG. 2 is an exploded view of FIG. 1 which more clearly shows separate elements of the system.

FIG. 1 depicts an installed embodiment of an openable auxiliary window when the window is closed and the panes are sealed. The exploded view of FIG. 2 more clearly indicates the separate elements assembled in the FIG. 1 installation. In FIG. 2, a prime window has a top header indicated by 1, side framing, 2 and 3, and sill 4. While a particular form of conventional window is shown, there are many other types of windows or wall openings to which the invention may be applied in accordance with the invention, including prime windows without sill members. Hence, more generally the system is intended to be installed on a surface surrounding the perimeter of an opening in a building wall.

As shown in FIG. 2, the window system includes two separate glazing panes, 5 and 6, which as will be described in more detail below, are joined by a hinge strip, 7. Two perimeter trim strips, 8 and 11, and 9 and 12, are applied to each side edge of the glazing panes, trim strip 10 is applied to the top; sill piece 13 is provided at the bottom. Sill strip 13 is conventional and includes embodiments such as depicted in U.S. Pat. Nos. 3,939,620; 4,184,297 and 4,248,018. The complete assembly of the glazing panes, (or alternate panels described below) hinge strip, (if desired), perimeter trim and sill piece (if necessary) constitutes the removable auxiliary element of the system. In the system, magnetic strips 14, 15 and 16 are provided around the perimeter header and sides of the prime window and maintain the auxiliary system in magnetic attraction to the prime window frame. If the prime window with which the auxiliary system is to be used does not include a sill, then a magnetic strip, corresponding to 15, is supplied at the bottom as represented by 43 in the embodiment of FIG. 2A.

Figure 2A:
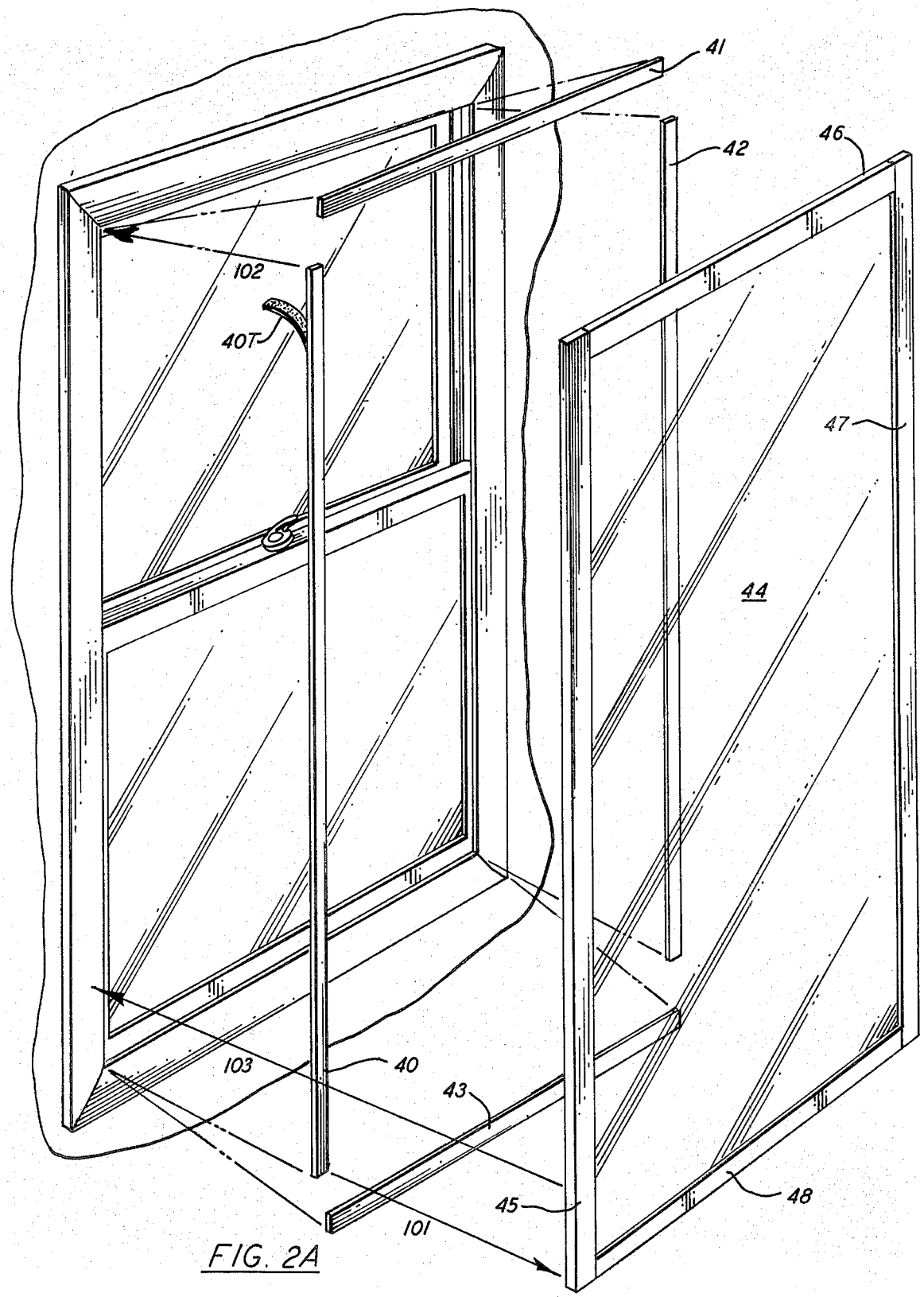
FIG. 2A shows an alternate installation.

The central hinge 7 which joins two glazing panels of the window is optional; one piece of glazing may be used for the entire window or other prior art types of jointer strips may be used with multiple glazing panes. For example, U.S. Pat. No. 4,184,297 depicts such a strip at FIG. 4. If an opening hinge is not employed, it is evident that the perimeter strip along each edge of the glazing may be a single length. Such an embodiment is depicted in FIG. 2A.

The individual elements of the system are described below:

I. THE PERIMETER TRIM

Figure 4:
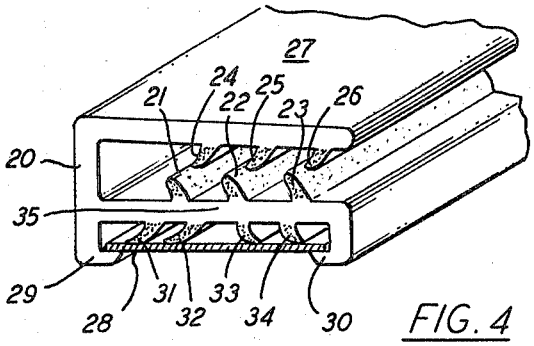
FIG. 4 is a perspective view of extruded perimeter channel trim strip for glazing panels.

A length of the perimeter trip strips (8, 9, 10, 11 and 12 of FIG. 2; 45, 46, 47 and 48 of FIG. 2A) is depicted in perspective in FIG. 4.

Preferably, the strip is co-extruded from two polyvinyl chloride plastics to produce a dual durometer strip. As is known in co-extrusion art, in making the strip, a rigid and flexible vinyl are fed into separate intake manifolds of an extruder and are simultaneously extruded thru the same die at the portions of the die corresponding to the intended feature of the extrusion which is to utilize a predetermined type of vinyl. The perimeter trim strips of the invention are principally rigid plastic channel forming members which include a flexible, softer or resilient compatible plastic to provide sealing gaskets for the pane receiving channel and in the slot which encloses the metal band which provides the element of the perimeter trim which is magnetically attracted to the strip at the prime window.

As shown in FIG. 4, the one piece rigid trim strip is indicated by reference numeral 20 and co-extruded gasket sealing "feathers" are formed from softer, resilient, flexible plastic. The "feathers" within the pane receiving channel are shown at 21, 22, 23, 24, 25 and 26. Preferably, one of the elements of the integral rigid plastic strip which forms the pane receiving channel (usually the upper member 27) is angularly disposed inwardly toward the open end of the channel to provide a tight, secure tension fit when a pane is inserted. For reception of a glazing pane 0.125 inch in thickness, the open end of the channel would typically be 0.130 inch, tapering to 0.170 at the closed end of the channel. The resilient gasket feathers would typically extend inwardly 0.050 inch in the channel.

The element of the perimeter trim strip which is attracted to the magnetic strips applied to the perimeter of the prime window frame is a magnetically attractable metal band 28 which is co-extensive with the length of the perimeter strip and is maintained on each side edge thereof in a slot formed by legs 29 and 30 which extend from each side of the lower rigid member 35 of the pane receiving channel. Except for the legs which secure the band in the strip, one surface of the metal band is essentially unobstructed so that it may be attracted by the magnetic strip at the prime window. Between the other (outer facing) side of the metal band and the lower rigid channel member 35, there are provided further co-extruded gasket sealing feathers 31, 32, 33 and 34 along the length of the strip. These feathers between the lower pane holding channel member 35 and the metal band 28 provide a tensioned "float" when the metal of the perimeter trim is adjacent the magnetic strip at the prime window perimeter, i.e., the metal band is slightly flexible; the gaskets allow adaptations for this flexibility; if an uneven prime window perimeter is encountered, the metal band will adapt to the magnetic strip without producing significant distortion of the pane receiving channel because of the combined flexibility of the gasket and the metal banding. Attraction is optimized; in this connection, the flexible gaskets also provide improved air seal.

Figure 4A:
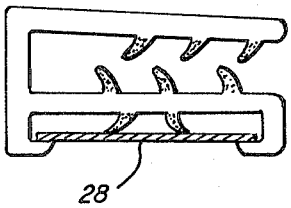
FIGS. 4A, 4B, and 4C depict extrusion profiles of other embodiments of perimeter channel trim strips.
Figure 4B:
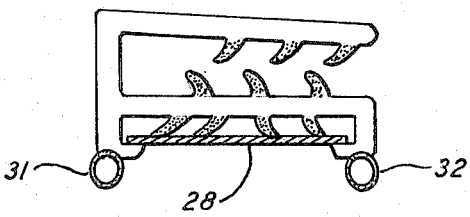
Figure 4C:
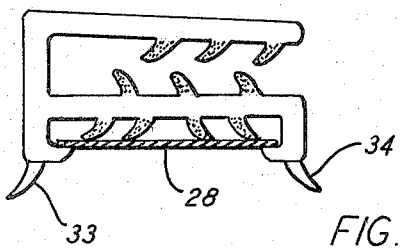
Figure 4D:
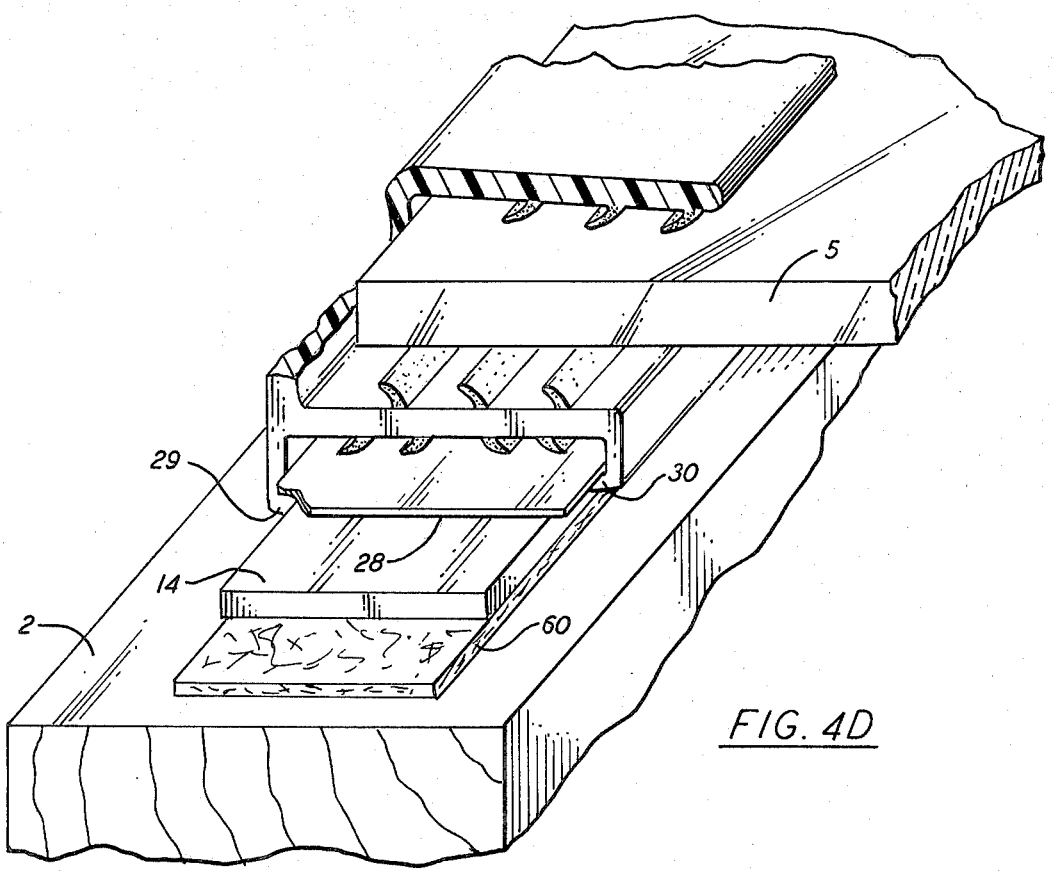
FIG. 4D is a cutaway perspective view showing the relationship of the various elements of the magnetic system as installed.

FIGS. 4A, 4B and 4C depict extrusion profiles of various embodiments of said perimeter strips. FIG. 4A shows a "pivot" profile which allows even greater flexibility. FIG. 4B shows a flexible "O" gasket co-extruded (from a resilient compatible plastic) to ends of the "legs" of the strip at 31 and 32. FIG. 4C depicts a similar gasket seal which may include either rigid or co-extruded flexible feathers such as are depicted at 33 and 34.

It is not necessary that as many as four feathers be included between the lower channel member and the metal band. When two central feathers are provided a desirable triangular "pivot" is created which may provide greater advantages and increased flexibility in the events of bowing of the glazing due to thermal expansion. In this regard, suitable alternatives to feathers may also be provided in accord with the skill of the art.

The selection of an appropriate rigid and flexible vinyl for co-extrusion is in accord with skill of the art, depending on the design parameters and intended conditions of use for any particular application.

Substitution of other plastics is possible. For example, polypropylene or high density polyethylene, both relatively rigid plastics, may be used in making the framing strips. Separate foamed insulating tape may be applied as gaskets in lieu of the co-extruded "feather" gaskets. Another dual durometer alternative consists of filled polypropylene as the rigid plastic, co-extruded with polyurethane as the softer, resilient plastic.

II. THE MAGNETIC STRIPS

The companion member of the metal band in each perimeter strip of the window system of the invention is a magnetic strip which is applied to the prime window perimeter to provide the magnetic attraction force which holds the auxiliary window element to the prime window. No invention is claimed with respect to such magnetic strips, per se. As shown in FIG. 2, these magnetic strips 14, 15, and 16 are applied to the plane surface at the perimeter of the prime window opening. The magnetic tape strips are preferably a barium ferrite impregnated vinyl material which is magnetized after being produced by calendering or extrusion. Such types of strips are commercially available and include products manufactured by B.F. Goodrich Company, Akron, Ohio under the trademark "Koroseal" or General Tire and Rubber, Industrial Products Division, Evansville, Ind. under the trademark "Gen-Mag." Since the thickness and the number of poles of the magnet affect its holding power, these magnetic parameters may vary in accord with other specific design requirements of a particular window system of the invention.

A typical strip which has been found useful for a normal sized window is 0.50 inch wide by 0.085 inch thick and has a magnetic minimum pull strength of seven pounds per foot.

Conventional means, such as double backed adhesive foam tape may be used to apply the magnetic strips to the wall. The use of such tape is illustrated by reference numerals 60 appearing in the cross-sectional depictions of FIGS. 3 and 3A. Screws, nails, staples, sealant glue, adhesive, or other suitable means may also be used to affix the magnetic strips to the prime window frame or to the wall around the opening intended to be covered by the window of the invention.

In the foregoing description it is implicit, as would be known to one skilled in the art that the size of the auxiliary window of the invention is appropriately correlated to the size of the opening to which it is to be applied. It is within the skill of the art that this size correlation is performed.

III. THE OPENING HINGE

As noted earlier, the window system may include a joining hinge as an option to allow the auxiliary window to be conveniently opened. It is not necessary that the joining hinge be included, and for many applications a single glazing pane surrounded by a perimeter trim (and sill strip if appropriate) is satisfactory. One such type of installation is depicted in FIG. 2A in which the magnetic strips surrounding the prime window are indicated by 40, 41, 42, and 43. The auxiliary glazing pane includes perimeter strips of the system as indicated at 45, 46, 47 and 48. In FIG. 2A, the glazing is 44.

Figure 5:
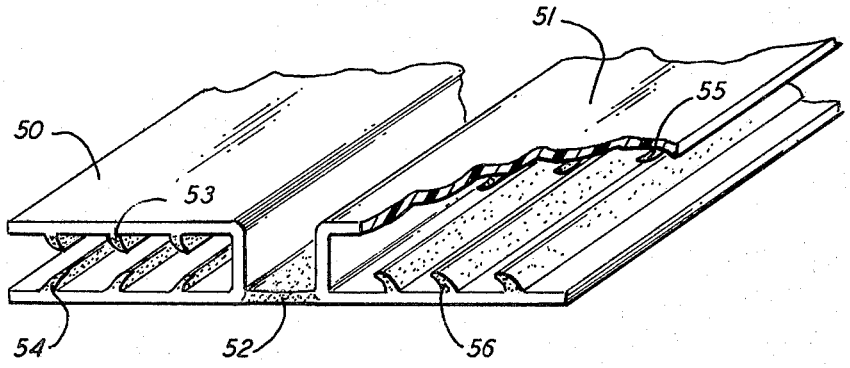
FIG. 5 is a perspective view of a length of the opening hinge, which may be used with the window system to join adjacent glazing panes.

FIGS. 5, 5A, 5B and 5C depict the joining hinge used with the system when an openable window is desired. As is the perimeter trim, the hinge is also preferably a dual durometer extrusion of a rigid and a compatible softer, flexible plastic—both preferably polyvinyl chloride. With reference to FIG. 5 it can be seen that the hinge includes oppositely facing "U" shaped members 50 and 51 formed from rigid polyvinyl chloride 50 and 51 which form pane receiving channels. The channels are joined, on one side of the "U" by an extending flexible bridging "hinge" element 52 formed from the co-extruded softer, flexible plastic.

Figure 5A:
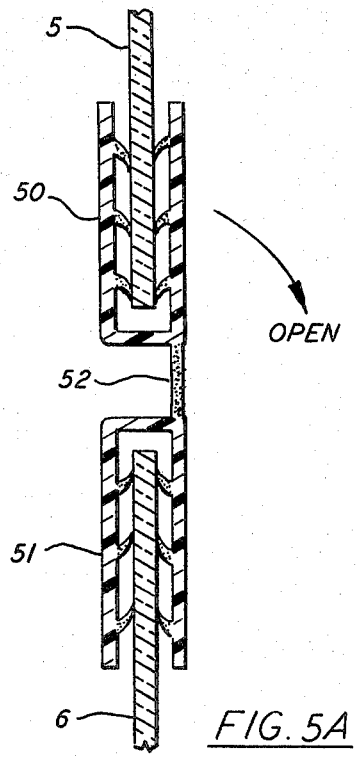
FIG. 5A details in cross-section the extrusion profile of the opening hinge of FIG. 5, with glazing panes included.
Figure 5B:
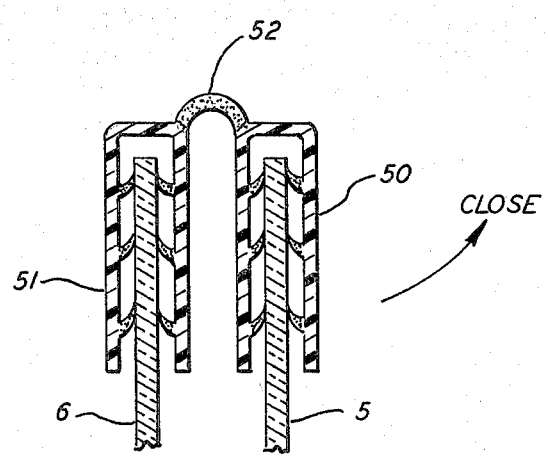
FIG. 5B details a cross-section of the opening hinge in the "open" position.
Figure 5C:
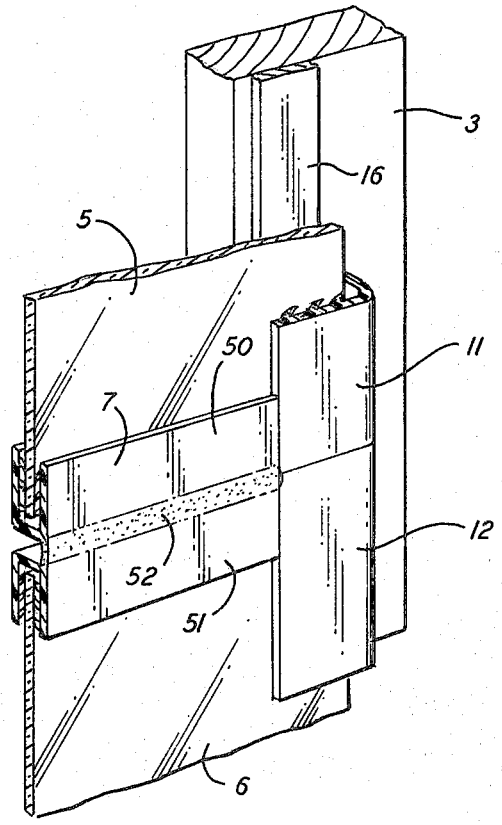
FIG. 5C depicts the relationship, as installed, of the hinge strip to other elements of the system.

The opening hinge also includes co-extruded longitudinally co-extending softer, flexible gasket sealing feathers on the inside surfaces of the channel of each "U" member, e.g., 53, 54, 55 and 56, which receives the glazing pane. [For clarity, reference numerals on the remaining feathers are omitted.] FIGS. 5A, 5B and 5C more clearly depict the operation of the opening hinge and its relationship to the other members which comprise the system. FIGS. 5A and 5B show a cross section of the hinge element, as identified by reference number 7, as employed in the window system depicted in FIGS. 1 and 2. When closed the upper glazing pane 5 is securely held to the prime window by the magnetic attraction between the metal band in the glazing perimeter trim strips 9, 10 and 11 and the magnetic strips 14, 15 and 16 to provide a sealed window. To open the window, the assembled upper pane is pulled away from the magnets and, rotating on the soft, resilient, hinge element, hangs pendulously downwardly from the hinge, essentially parallel to pane 6, in the manner depicted in FIG. 5B. As FIG. 5B shows, the flexible element of the hinge 52, preferably forms a regular arch shape when the window is open. FIG. 5C (using the reference numerals of FIGS. 1 and 2 and 5) depicts the preferred relationship of the opening hinge to the elements of the window system at the sides of the window. It is seen that the hinge member 7, preferably does not extend the entire width of the glazing panes 5 and 6 which it joins. A segment of the pane extends which is inserted into the respective pane receiving channels of perimeter strips 11 and 12.

IV. THE ASSEMBLED SYSTEMS

Figure 3A:
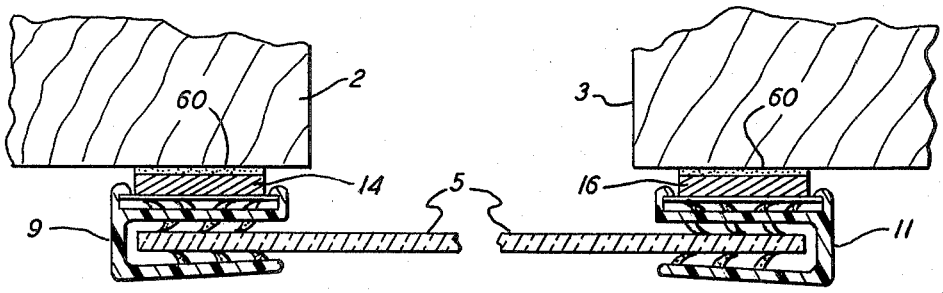
FIG. 3 and FIG. 3A respectively depict a vertical cross-section (Section 3—3 of FIG. 1) and a horizontal cross-section (Section 3A—3A of FIG. 1) of the window of FIG. 1.
Figure 3:
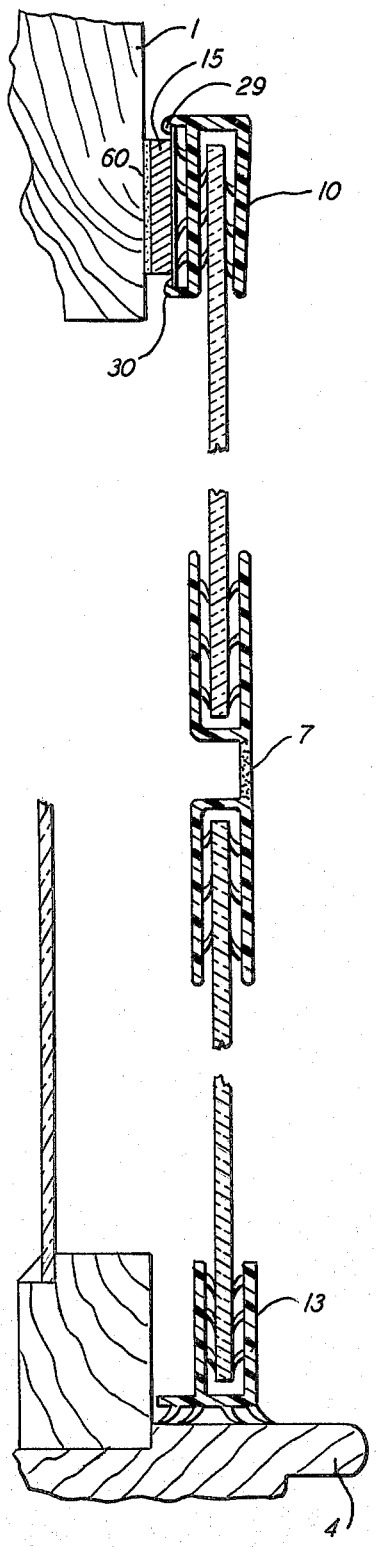

Cross-sections of the installed system are shown in FIGS. 3 and 3A. With reference to both cross-sections, it is seen that the "legs" (29 and 30) of FIG. 3, of the perimeter trim not only hold the metal banding but also overlap the magnetic strip (15 of FIG. 3). This overlap lip provides a stabilization for the system since the overlap prevents substantial vertical or horizontal movement of the panel assemblies with respect to the magnetic strips applied to the prime window perimeter. Thus, the window system should not slide downwardly as a result of gravitational force overcoming magnetic attraction in applications without a sill, nor should the window shift horizontally. Further: (1) the overlap of the legs provides positive and secure alignment for the pane with respect to the magnetic strips which results in more facile removal and installation of the window system; (2) the opening and closing of a pane when the system includes an opening hinge is facilitated.

In its preferred embodiment, the window of the invention is employed as an interior insulating window in conjunction with an existing prime window. When so employed, the prime window shields the insulating window from the outside environment. Accordingly, the system may be extruded in lightweight plastic. In such applications, glazing panes of extruded acrylic or styrene plastic compositions of a thickness of 0.080 to 0.125 inch are customarily employed. A conventional depth of the channel holding the edges of the glazing panes would be approximately 0.630 inch; the rigid sides of the channel forming members would typically be 0.045 to 0.055 inch in thickness. Other compatible dimensions for elements of the system should be readily apparent given these preferred dimensions of a principal element.

V. INSTALLATION INSTRUCTIONS

In the installation of the window system of the invention, it is preferred that the auxiliary glazing pane is first cut to size to adapt to the prime window opening. The perimeter trim is then applied to the side edges of the glazing. As illustrated in the various figures of which FIG. 3A is representative, a slight tolerance gap is preferably provided between the closed back end of the channel and the edge of the glazing pane. Typically the gap is about 0.125 inch and allows space for thermal expansion of the glazing pane. Allowance for the gap is provided when the glazing is first cut to size. In turn the gap also accommodates slight errors in sizing. Preferably, the magnetic strips are then "attached" (by their magnetic attraction) to the metal banding of the perimeter trim. In the preferred manner of installation, the glazing includes the applied perimeter trim, with the magnetic strips attached, as a unit before the window system is installed at the prime window.

Normally, the magnetic stripping may include one self-adhesive side (opposite the side magnetically attached to the steel banding) or a double faced adhesive tape is applied to one side of the magnetic strip. Usually this adhesive surface is protected by a tape. This tape is then removed, and the completed assembly is applied to the prime window at the predetermined locations where the magnetic strip will adhere to the perimeter surface.

FIG. 2A illustrates a first method step 101 of attaching magnetic strip 40 to a perimeter strip 45 in assembling a window unit. Protective tape 40T is then removed from the magnetic strip in step 102 and the unit is then applied to the prime window in step 103. The adhesive side of the magnetic strip will adhere to the surface adjacent the prime window. The window unit is removable; the magnetic strips remain attached to the prime window. Other evident means of installation will suggest themselves depending on considerations such as window size, the manner in which the magnetic strips are attached, personal habit of the installer, etc.

Alternatively, the perimeter trim strips may be supplied with the magnetic strips integrally attached to the metal banding, so that both will be cut identically together in the sizing step. This provides the advantage of preserving the magnetization of the strip during manufacturer/distributor stocking; limits inventory considerations to one piece; and allows one-step assembly of the glazing unit.

VI. THE ACCESSORY CLIPS

Figure 6:
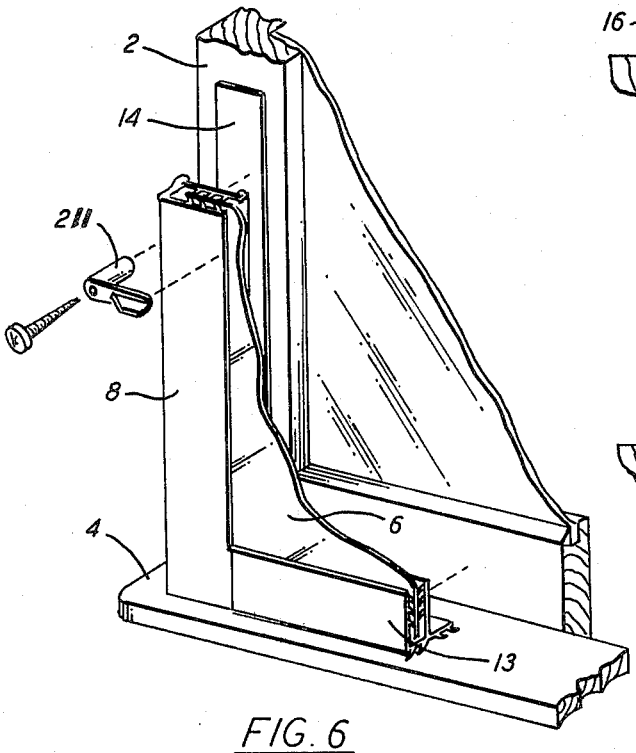
FIG. 6 shows a detail of a lower corner of the window system depicting the application of an accessory clip.

Preferably, the installed window system may be used in conjunction with the accessory clips such as are shown and depicted in FIG. 6 at 211. Such clips may be provided if the auxiliary panel can be removed easily despite the magnetically attractive force. In the absence of accessory panel clips, in opening a hinged window, someone not totally familiar with the system may use excessive force and completely separate the window unit from the magnet strips 14 at the prime window. If one is not prepared quickly to hold the window, it could fall; use of the clips provides a means which makes such an occurrence unlikely.

Also, in this regard, if excessive pressure created by ambient winds builds up between the prime window and the auxiliary window, the magnetic attraction between prime window strip 14 and perimeter strip 18 may be overcome, allowing the pressure to relieve itself. While it is unlikely that the auxiliary window panel of the application can be dislocated by the creation of wind pressure, such pressure can theoretically become high enough on larger size windows that the wind pressure force exceeds the magnetic holding force. These pressures depend on the infiltration rate of the wind relative to the window and the air temperature; typical pressures are set forth in Table I.

TABLE I

| Wind Velocity | Maximum Pressure |
|---|---|
| 25 MPH | 1.5 lbs./ft.$^2$ |
| 35 MPH | 2.9 lbs./ft.$^2$ |
| 50 MPH | 6.0 lbs./ft.$^2$ |

The clips provide a safety back-up for high wind velocities, leaky windows, and poor installations.

The clips also provide a positive stop and safety back-up against excessive thermal expansion. As noted above, when the perimeter trim is applied to the glazing, a gap of about 0.125 inch is typically allowed between the end of the glazing material and the inside back of the perimeter trim. This gap (in conjunction with the gaskets) allows for some thermal expansion of the glazing material in the trim as well as for some size adjustment of the glazing material and the trim after the magnetic tape is applied to the window frame. Clearance provided between the magnetic tape and the lip on the trim allows an additional 0.040 inch expansion with respect to planar vectors corresponding to the perimeter surface. The lip on the perimeter trim will tend to restrict the trim from sliding over the magnetic tape in the event of great thermal expansion. In such instances of excessive expansion, when plastic glazing is used, the plastic may bow, notwithstanding the "float" feature, and the resulting force may be sufficient to lift the lip of the perimeter trim over the magnetic tape. The accessory clip tends to prevent detachments, prevent the lip from clearing the magnetic trim, and prevent the trim from sliding over the magnetic tape.

VII. ALTERNATIVE PANELS

Because the magnetic strips are the members of the system which are permanently attached to the prime window frame, the system of the invention is economically adaptable to seasonal needs. For example, clear glazing useful in winter may be removed and solar control glazing, reflective film, or insect screening may be provided in warmer seasons. Such alternate seasonal panels are preferably mounted in perimeter trim adapted to the type of panel used. For seasonal changes, the one would be removed, and the other substituted.

Figure 7A:
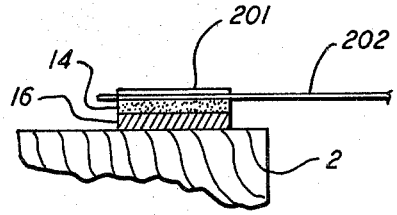
FIGS. 7A, 7B, 7C, 7D and 7E show different types of panels and elements thereof which are useful as alternate environmental control elements of the system.
Figure 7B:
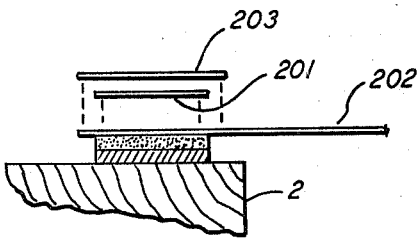
Figure 7C:
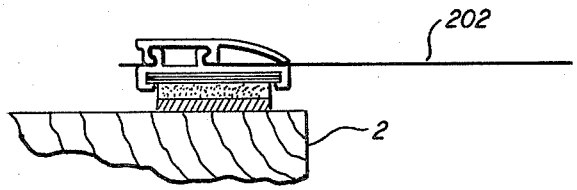
Figure 7D:
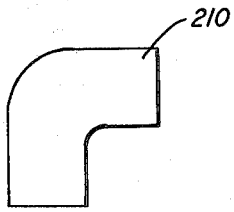
Figure 7E:
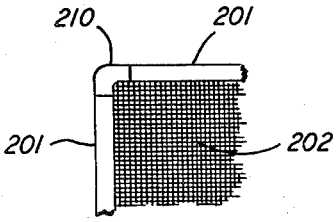

Such alternative embodiments include a screen, sun screen, or reflective film panel. With the magnetic tape already on the window frame, suitable alternative panels may include a frame which contains a steel piece, as shown in the embodiments depicted in FIGS. 7A, 7B or 7C. Such a frame may be a simple steel banding 201 used to hold the screen or film material 202 as shown in FIG. 7A. As shown in FIG. 7B a decorative tape 203 may be used to cover the steel band. A screen may be inserted into a two element interlockable plastic trim piece having a steel band, which holds the film or screen as shown in FIG. 7C. This latter alternative of FIG. 7C can also be used as a replaceable low cost storm window using a relatively flexible clear film. In these embodiments, a simple stamped steel corner piece 210 such as shown in FIGS. 7D and 7E may be used to join the respective sides of the panels as shown in the detail of a screen corner shown at FIG. 7E.

Figure 8:
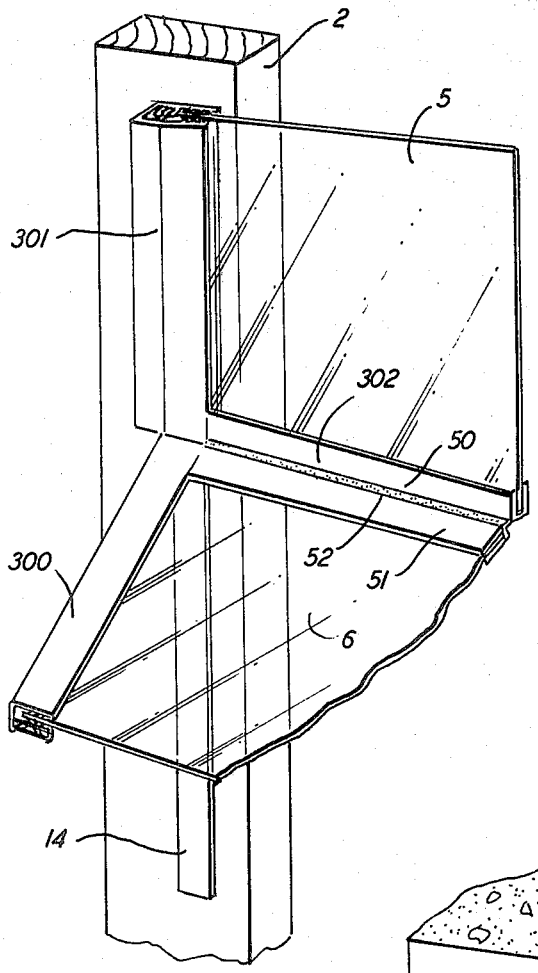
FIG. 8 is a detail of an openable "combination" window which includes the system of the application in conjunction with conventional perimeter trim.

A combination window using a conventional auxiliary window perimeter strip and the magnetic system of the invention may also be provided. As shown in FIG. 8 the magnetic system of the application 300 will be used in combination with conventional non-magnetic perimeter trim such as described in U.S. Pat. Nos. 3,939,620 and 4,184,297 (identified as 301) and a hinge of the system 302 to produce a conveniently openable window. A permanent type upper window is mechanically secured; the lower hinged transom window, which uses the magnetic trim can be easily opened and closed as needed.

VIII. THE INTERIOR PERIMETER SYSTEM

Figure 9B:
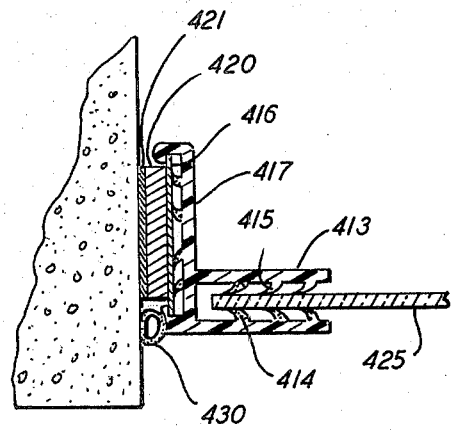
FIGS. 9, 9A, 9B and 9C depict a system of the application adapted for installation in the interior perimeter of a window recess.
Figure 9C:
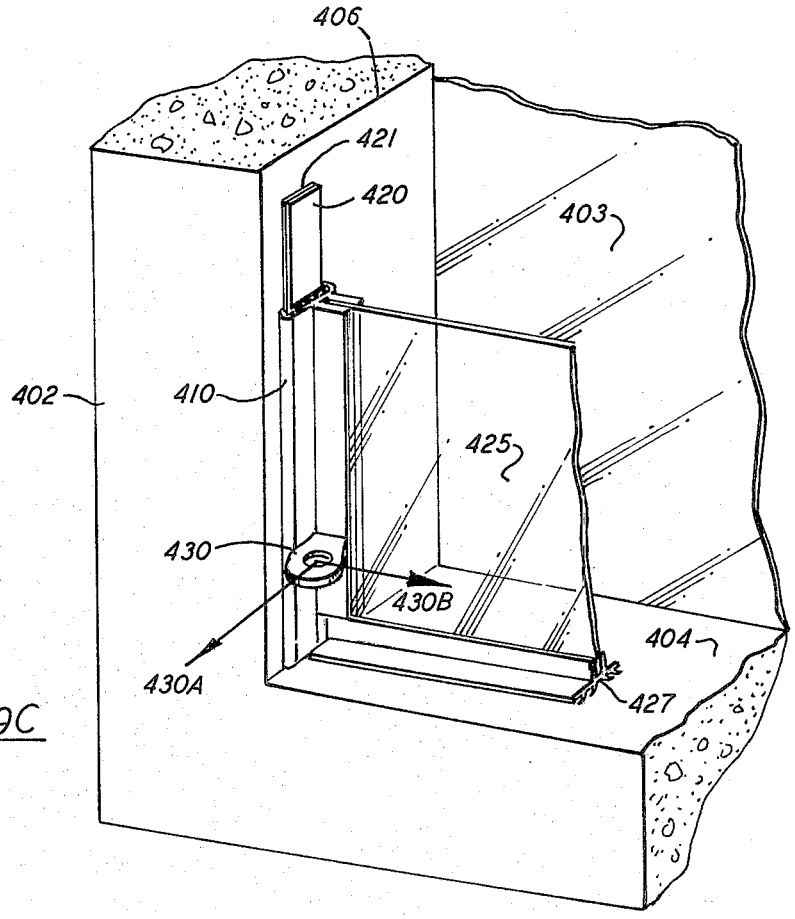
Figure 9:
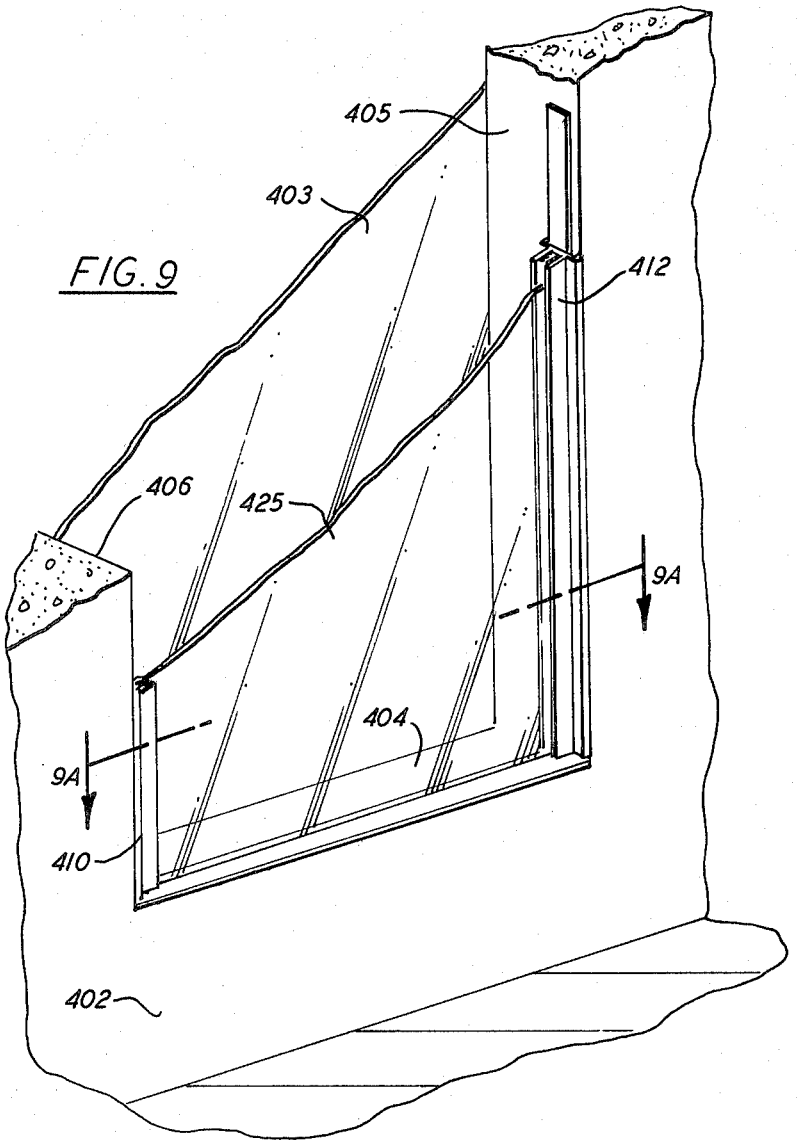
Figure 9A:
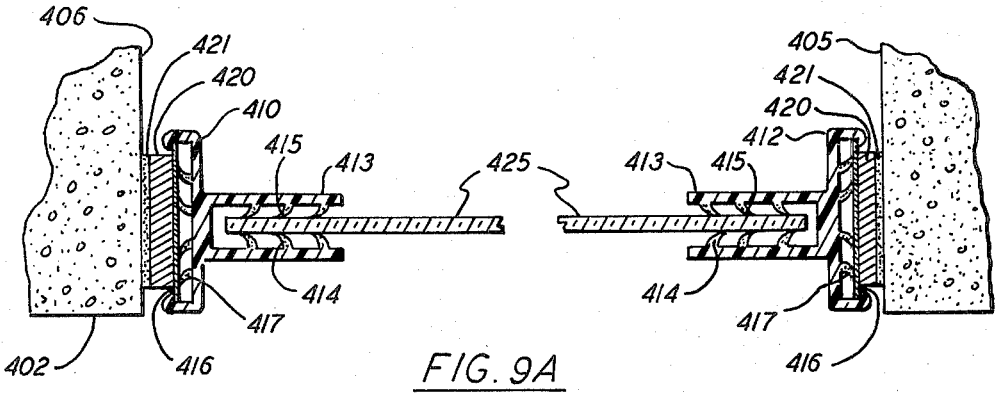

A further alternative perimeter strip is set forth in the embodiments which are depicted in the profile cross-sections in FIGS. 9A and 9B which represent an "interior" perimeter installation as depicted in FIG. 9. In this embodiment, the auxiliary window system is included within a wall recess defined by an interior perimeter surrounding the prime window, rather than on the plane surface of the wall. Such an embodiment is particularly useful for commercial and/or institutional uses in buildings where prime windows are normally deeply recessed in a standardized unit structure and it is desired that an auxiliary window be applied within the recess. In this manner, encumbrance of the wall surrounding the window perimeter is avoided and the auxiliary window may even be mounted flush with the wall surface.

With reference to FIG. 9, the building wall is indicated at 402. Existing prime window 403 is recessed some distance from the interior surface of the building wall. The perimeter which extends perpendicularly from the prime window, three surfaces of which are indicated at 404, 405 and 406 usually consists of a metal window unit and/or masonry or gypsum material.

The principal elements of the system remain essentially the same as are included in the exterior perimeter embodiment previously described. With reference to FIG. 9A which depicts the indicated cross-section of FIG. 9, it can be seen that intrinsic dual durometer extruded perimeter strips 410 and 412 include the same pane receiving channel forming member 413 having resilient gasket sealing members, e.g. 414, 415. The "floating" magnetic attraction means includes metal banding 416 and resilient gasket means, e.g. 417, in the same manner as described above with reference to the "exterior" embodiments. Magnetic attraction means 420 is similarly applied to the building wall by double faced adhesive tape 421 or other means. The auxiliary glazing pane of this embodiment is indicated by 425.

FIG. 9B depicts another alternative of the interior perimeter embodiment in which the pane holding channel element of the strip, which may be at any location with respect to the magnetic means, is applied perpendicularly at an end with respect to the magnetic attraction means and includes additional gasket sealing features, such as feathers, loops, etc., such as depicted in the figure at 430.

The aspects of the dual durometer extrusion, sizing, installation, and assembly of this embodiment correspond to the skill of the art and to the similar features of the "exterior perimeter" embodiment previously described. Similarly, other types of panels, an opening hinge and other combinations previously described may also be employed in conjunction with this embodiment.

One advantage achieved by the interior embodiment is greater adaptability to sizing inaccuracies and additional allowance for contraction of the plastic glazing if caused by a temperature differential, i.e. the magnetic means will hold the perimeter strip to the window and the resilient feathers in the pane holding channel and floating band allow slight movement of the pane wih respect to a fixed interior perimeter. Furthermore, the extending legs which enclose the metal band of the perimeter strip provide a secure placement of the auxiliary window with respect to inward or outward movement since the "legs" essentially embrace the fixed magnetic strips applied to the wall. And because the auxiliary window is mounted in an inside recess, the risk of displacement, by gravity or external forces is reduced.

While magnetic attraction means may be employed at all four sides of the perimeter in this interior embodiment, such strips applied to two opposite sides, or strips applied to three sides of the perimeter are useful alternatives. In such instances a conventional sill strip (such as depicted at 13 in FIGS. 2 and 3 herein and also referred to in U.S. Pat. Nos. 3,939,620; 4,184,297 and 4,248,018) may be applied to the remaining sides of the perimeter as depicted in the detail of FIG. 9C at 427.

In the installation of this embodiment with respect to fixed magnetic strips, the glazing with the perimeter strips simply snaps over the applied magnetic strips so that the legs of the perimeter strips embrace the magnetic strip. A "snap in" is allowed by reason of the tolerance gap of the glazing and the resilience of the gaskets in the perimeter strips. To allow facile detachment of the window, a pull loop, ring or other means may be preferably provided at an upper or lower location on the perimeter strip such as is depicted at 430 in FIG. 9C. A swift pull on the loop indicated by the vector 430A, and if necessary, the exertion of a slight force towards the center of the glazing, indicated by the vector 430B will allow the window to "pop-out." To facilitate this removal, a slight gap is provided between perimeter strips at the corners of the system, as illustrated in FIG. 9C at the corner between members 427 and 410.

In the foregoing the overall elements of the system have been described and it is apparent that such elements can be combined in many different ways to provide optimum windows for many different applications and environmental conditions.

What is claimed is:

1. In an auxiliary window system for a prime window, in which system:

(1) a perimeter strip is applied to the edge of a glazing pane along a portion of the perimeter thereof, receiving a portion of the pane edge in a longitudinally extending channel therein, which channel in cross-section is formed by upper and lower channel forming segments of an integral member; and (2) the perimeter strip includes a magnetically attractable means adjacent and essentially parallel to the channel forming segment of the perimeter strip, which magnetically attractable means longitudinally co-extends along an outer surface of said channel forming segment; and (3) said magnetically attractable means is for attachment with respect to corresponding magnetic attraction means applied adjacent the perimeter of the prime window, the improved perimeter strip which includes:

(4) longitudinally extending inwardly facing resilient gaskets on the inner surfaces of the pane edge receiving channel formed by the upper and lower cross-sectional segments of the integral perimeter strip member; and (5) resilient gasket feather means integrally applied to an outer surface of the channel forming segment of the perimeter strip member on a side of the channel forming segment facing the magnetically attractable means which is adjacent thereto, said gasket feather means (a) longitudinally coextending along said outer surface (b) in a sealing relationship with said magnetically attractable means and (c) providing a flexibly tensioned relationship between said channel forming segment and the magnetically attractable means adjacent thereto.

2. The strip of claim 1 in which the magnetically attractable means is a longitudinally extending metal band and the lower segment of the member includes intrinsic rigid facing legs perpendicularly extending therefrom at opposite sides of the width thereof, and the metal band is maintained adjacent the member within the space defined by the facing legs.

3. The strip of claim 2 including further gasket means extending outwardly from the legs, whereby said gasket means overlaps the magnetic attraction means applied adjacent the prime window when the perimeter strip is installed thereto.

4. The strip of claim 2 consisting of a dual durometer vinyl plastic extrusion.

5. The strip of claim 2 in which the rigid plastic is a polypropylene composition and the co-extruded flexible plastic is a polyurethane composition.

6. The strip of claim 1 in which the resilient gasket means between the channel forming member and the magnetically attractable means is approximately centrally located with respect to the width of the member and the magnetically attractable means, whereby the magnetically attractable means is maintained in a floating pivot relationship with respect to the member.

7. The strip of claim 1 consisting of a dual durometer plastic extrusion in which the integral member is principally formed from a rigid plastic and the longitudinally extending resilient gaskets are formed from an integrally co-extruded flexible plastic which is compatible with the rigid plastic.

8. The strip of claim 7 in which the gaskets consist of a plurality of co-extruded feathers formed from the flexible plastic.

* * * * *